US005087096A

United States Patent [19]

Yamazaki

[11] Patent Number: 5,087,096

[45] Date of Patent: Feb. 11, 1992

[54] APPARATUS FOR DISPLACING EXTENSIBLE/CONTRACTIBLE BOARD FOR CHAIR IN CASE OF EMERGENCY

[75] Inventor: Ryokichi Yamazaki, Tokyo, Japan

[73] Assignee: Kabushiki Kaisha Kotobuki, Tokyo, Japan

[21] Appl. No.: 510,525

[22] Filed: Apr. 18, 1990

[30] Foreign Application Priority Data

Apr. 28, 1989 [JP] Japan ..... 1-110676

[51] Int. Cl.[5] ..... A47C 39/00

[52] U.S. Cl. ..... 297/145; 297/162

[58] Field of Search ..... 297/145, 162, 194, 155

[56] References Cited

U.S. PATENT DOCUMENTS

| | | | |
|---|---|---|---|
| 936,017 | 10/1909 | McClelland | 297/162 |
| 1,093,686 | 4/1914 | Cogger | 297/162 |
| 1,649,761 | 11/1927 | Vinggrad | 297/145 X |
| 1,731,293 | 10/1929 | Chapman | 297/162 |
| 3,269,772 | 8/1966 | Brunskole | 297/162 |
| 3,547,488 | 12/1970 | Barnes | 297/162 |
| 3,632,161 | 1/1972 | Arfaras | 297/145 |
| 4,852,940 | 8/1989 | Kanigowski | 297/145 |
| 4,944,552 | 7/1990 | Harris | 297/145 |

FOREIGN PATENT DOCUMENTS

| | | | |
|---|---|---|---|
| 116999 | of 1929 | Austria | 297/145 |
| WO02550 | 8/1983 | PCT Int'l Appl. | 297/145 |
| 456791 | 11/1936 | United Kingdom | 297/145 |

*Primary Examiner*—Jose V. Chen

*Attorney, Agent, or Firm*—Oldham & Oldham Co.

[57] ABSTRACT

An unique apparatus for displacing an extensible/contractible board for a chair in case of an occurrence of emergency is disclosed. The apparatus includes a board support, an engagement piece, a turn guide plate, a stationary guide plate and an opposing pair of base members. The board assumes a horizontal attitude during normal use. In case of emergency, an excessive magnitude of outer force in excess of resilient force derived from Belleville springs is imparted to the board by an user's hand so that the engagement piece is disengaged from the turn guide plate via operative engagement of an eccentric projection on the board shaft with an engagement recess on the engagement piece. This causes the board to be displaced from the horizontal attitude to a vertical attitude, whereby a sufficiently wide space is provided in front of the user so as to enable him to quickly escape from his chair. When the board is not in use, the board is received in a hollow space defined by an opposing pair of sleeve plates below one elbow rest of the chair.

9 Claims, 4 Drawing Sheets

APPARATUS FOR DISPLACING EXTENSIBLE/CONTRACTIBLE BOARD FOR CHAIR IN CASE OF EMERGENCY

BACKGROUND OF THE INVENTION

1. Field of the Invention

The present invention relate generally to an apparatus for displacing an extensible/contractible board for a chair. More specifically, the present invention relates to an apparatus for displacing an extensible/contractible board for a chair installed in a theater, a convention hall, a train, an aircraft, a ship or the like particularly in case of an occurrence of emergency, e.g., earthquake, fire or the like. Here, it should be noted that the extensible/contractible board for the apparatus designates such a board that it is forwardly taken out of a hollow space below one elbow. rest of the chair when it is put in practical use and it is received in the hollow space when it is not in use.

2. Description of the Background Art

Generally, a number of chairs installed on a theater, a convention hall, a train, an aircraft, a ship or the like are arranged in the transverse direction with a certain distance kept between respective front and rear rows. With such transverse arrangement of the chairs as described above, a space required for installing each chair is effectively utilized, and each transversely extending space between the front and rear rows serves as a passage for allowing users to go forward to look for their seat and leave there later.

In some case, each chair is equipped with an extensible/contractible board having a small area in view of convenience at the time when an user takes a note or eats something. This kind of conventional board is constructed such that it is forwardly taken out of a hollow space below on elbow rest of the chair when it is to be in use and then it continuously maintain a horizontal attitude during his use.

With the conventional extensible/contractible board for a chair, however, it has been found that it has the following drawbacks.

Specifically, when the board is in use, it is projected forwardly of the front surface of the elbow rest while maintaining the horizontal attitude. Thus, the transversely extending passage between front and rear rows is occupied by the projected board. If there arises a necessity for allowing an user sitting on his chair to quickly escape therefrom due to an occurrence of emergency, e.g., earthquake, fire or the like, the projected board becomes an obstacle for him. This may lead to a serious result, e.g., physical hurt or injury of each user.

In addition, when the conventional board receives an excessive magnitude of outer force from the above, there is a danger that components associated with the board to support it are damaged or broken, because they can not absorb the outer force or they can not resist against it. If an unit for preventing these components from being damaged or broken is arranged for the board, the result is that it is unavoidably designed and constructed in larger dimensions at an expensive cost.

SUMMARY OF THE INVENTION

The present invention has been made with the foregoing background in mind.

An object of the present invention is to provide an apparatus for displacing an extensible/contractible board for a chair in case of an occurrence of emergency wherein the board is turned down from a horizontal attitude merely by depressing it from the above so that a sufficiently wide space is provided in front of an user sitting on his chair when there arises a necessity for allowing him to quickly escape therefrom via a transversely extending passage at the time when an emergency, e.g., earthquake, fire or the like occurs.

Other object of the present invention is to provide an apparatus for displacing an extensible/contractible board for a chair in case of an occurrence of emergency wherein even when an excessive magnitude of outer force is imparted to the board during normal use for some reason, it is smoothly and easily absorbed without damage or breakage of components associated with the board.

Another object of the present invention is to provide an apparatus for displacing an extensible/contractible board for a chair in case of an occurrence of emergency wherein the apparatus is simply designed and constructed in smaller dimensions at an inexpensive cost.

To accomplish the above objects, the present invention provides an apparatus for displacing an extensible/contractible board for a chair in case of an occurrence of emergency, wherein the apparatus comprises a board support for turnably supporting the board, the board support being formed with a bearing hole for rotatably receiving a board shaft made integral with the board, an arcuate recess for turnably receiving an arcuate projection on the board shaft, the arcuate recess being located above the bearing hole, a shaft hole through which a thrust shaft is inserted, the shaft hole extending at a right angle relative to the board shaft and being located below the bearing hole, and a slide hole for slidably receiving an engagement piece, the slide hole being located at a position behind the shaft hole relative to the board, an engagement piece slidably received in the slide hole of the base support, the engagement piece having an engagement recess formed thereon so as to allow an eccentric projection on the board shaft to be engaged with the engagement recess, a turn guide plate disposed adjacent to the board support to guide turning movement of the board and the board support, the turn guide plate being formed with a shaft hole at the central part thereof through which a thrust shaft is inserted, an engagement aperture located in alignment with the slide hole of the board support so that a foremost end of the engagement piece is inserted therethrough when the engagement piece is projected outwardly of the board support by turning movement of the board via operative engagement of the eccentric projection of the board shaft with the engagement recess of the engagement piece, an opposing pair of engagement recesses for receiving an opposing pair of engagement projections on a stationary guide plate, one of the engagement recesses being located above the shaft hole and the other one being located below the shaft hole, and an arcuate guide groove for allowing the foremost end of the engagement piece to slidably move therealong when the board is turned from a horizontal attitude and thereby the engagement piece is retracted from a projected state via the operative engagement of the eccentric projection of the board shaft with the engagement recess of the engagement piece, a stationary guide plate immovably held on a thrust shaft which extends through a shaft hole at the central part thereof, the stationary guide plate being formed with an opposing pair of first engagement projections adapted to be engaged with the engagement recesses of the turn guide plate and an opposing pair of second engagement projections adapted to receive a flange portion of a thrust shaft, the second engagement projections being located opposite to the first engagement projections, a thrust shaft extending through the shaft hole of the stationary guide plate, the shaft hole of the turn guide plate, the shaft hole of the board support and a shaft hole of one base member at a right angle relative to the board shaft, the thrust shaft including a flange portion held between the second engagement projections to immovably hold the stationary guide plate and a male-threaded portion at the fore end part thereof, an opposing pair of base members firmly secured to the front surface at the foremost end of one elbow rest of the chair with the board support interposed therebetween, one of the base members being located adjacent to the board support to receive the turn guide plate and the stationary guide plate in a hole formed therein and the other one being likewise located adjacent to the board support with a spring receiving hole formed therein, and engagement assuring means for firmly holding the board support, the turn guide plate and the stationary guide plate in an operative engagement relationship under the effect of resilient force derived from the engagement assuring means.

It is preferable that the engagement assuring means comprises a plurality of Belleville springs for resiliently biasing the board support and the turn guide plate toward the stationary guide plate. In this case, the Belleville springs are received in the spring receiving hole of one base member.

Alternatively, the engagement assuring means may comprise a solenoid for biasing the board support and the turn guide plate toward the stationary guide plate as long as it is turned.

To assure that the apparatus of the present invention can be used also for other elbow rest of the chair, the turn guide plate is formed with another engagement aperture which is located in a symmetrical relationship relative to the foregoing engagement aperture.

Further, to assure that the engagement piece is disengaged from the engagement aperture of the turn guide plate in response to a large magnitude of outer force which is imparted to the board, a depth of the arcuate groove of the turn guide plate is set to coincide with a quantity of retractive displacement of the engagement piece.

The arcuate projection on the board shaft serves as turning movement limiting means for limiting the range of turning movement of the board from the horizontal attitude to the vertical attitude, i.e., for limiting turning movement of the board within the range of 180 degrees.

Other objects, features and advantages of the present invention will become more apparent from reading of the following description which has been made with reference to the accompanying drawings.

BRIEF DESCRIPTION OF THE DRAWINGS

The present invention is illustrated in the following drawings in which.

DESCRIPTION OF THE PREFERRED EMBODIMENT

Now, the present invention will be described in detail hereinafter with reference to the accompanying drawings which illustrate a preferred embodiment thereof.

Figure 7:
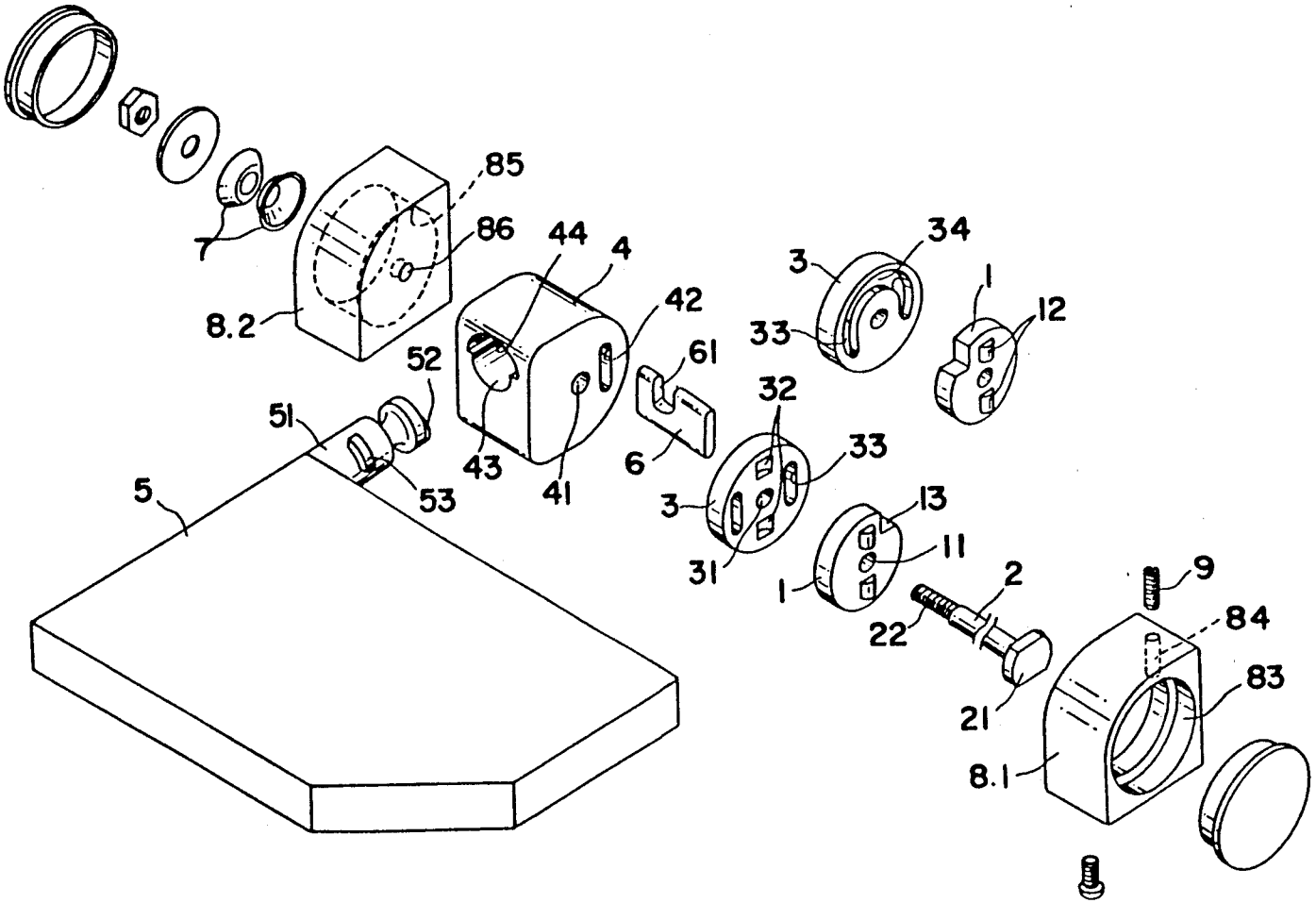
FIG. 7 is a perspective view of the apparatus in a completely disassembled state.

As shown in FIGS. 1 to 3 and FIG. 7, an apparatus of the present invention includes an extensible/contractible board 5 adapted to assumes a horizontal attitude during normal use and moreover turn down in case of an occurrence of emergency. The board 5 is designed in the form of a flat plate having a small area in view of convenience at the time when an user takes a note or eats something. A board shaft 51 is made integral with the board 5 on the rear edge so as to serve as a supporting member when the board 5 is to be turned upwardly or downwardly. As is best seen in FIG. 7, the board shaft 51 is formed with an eccentric projection 52 at the foremost end which will be brought in engagement with an engagement recess 61 on an engagement piece 6 to be described later. In addition, the board shaft 51 is formed with an arcuate projection 53 on the outer surface thereof which will serve as a turning movement limiting member when the board 5 is accurately turned within the range of 180 degrees after the board shaft 51 is rotatably inserted into a bearing hole 43 in a board support 4 which will be described in detail later.

As shown in FIGS. 1 to 3 and FIG. 7, the board support 4 has two vertical surfaces on the both sides which come in slidable contact with the inside vertical surfaces of stationary base members 8.1 and 8.2 when the whole apparatus is installed on the front surface at the foremost end part of an elbow rest 101 of a chair 10. A shaft hole 41 is drilled through the board support 4 so that a thrust shaft 2 to be described later can be inserted through the shaft hole 41. As is apparent from the drawings, the bearing hole 43 for rotatably supporting the board shaft 51 is located above the shaft hole 41 and extends at a right angle relative to the shaft hole 41. It should be noted that the upper half of the bearing hole 43 is contoured in the form of an arcuate recess so as to enable the arcuate projection 53 on the board shaft 51 to be exactly turned in the arcuate recess 44 within the range of 180 degrees. Thus, the board support 4 serves as an essential component for the apparatus of the present invention.

The apparatus of the present invention for supporting the extensible/contractible board 5 and turning down it from the horizontal attitude in case of an occurrence of emergency will be described below in more details.

Specifically, the thrust shaft 2 includes a flange portion 21 adapted to be operatively engaged with engagement projections 12 on a stationary guide plate 1 to be described later so that the stationary guide plate 1 is immovably held on a thrust shaft 2 when the thrust shaft 2 is inserted through the shaft hole 41. The thrust shaft 2 includes a male-threaded portion 22 at the fore part thereof so as to firmly hold essential components for the apparatus in a coaxial relationship, after an opposing pair of Belleville springs 7 serving as engagement assuring means to be described later are fitted onto the thrust shaft 4 and then tightened by rotating a nut.

The stationary guide plate 1 is immovably mounted on the thrust shaft 2 in the region adjacent to the flange portion 21. As shown in FIG. 7, the stationary guide plate 1 is formed with a shaft hole 11 at the central part thereof through which the thrust shaft 2 is inserted. In addition, the stationary guide plate 1 is formed with two semicylindrical engagement projections 12 adapted to be engaged with the corresponding engagement recesses 33 on a turn guide plate 3, one of the engagement projections 12 being located above the shaft hole 11 and the other one being located below the shaft hole 11.

Figure 2:
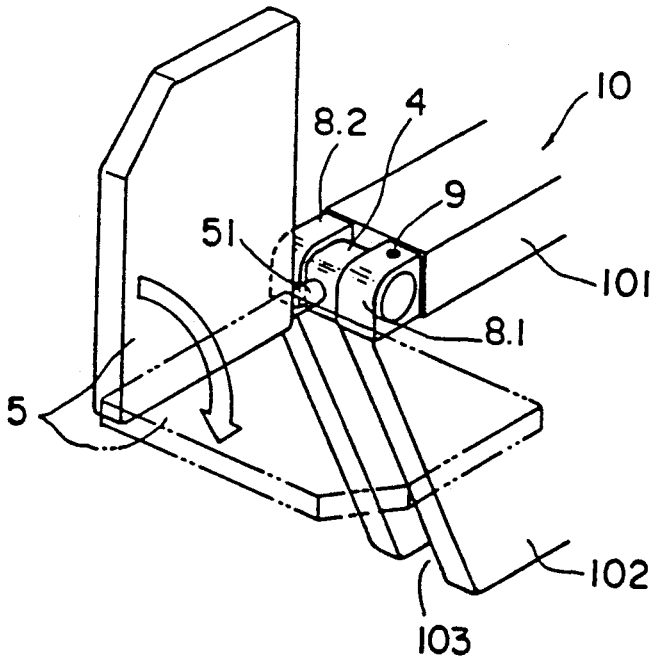
FIG. 2 is a perspective view of the apparatus illustrating an intermediate state wherein the board is turned up before it is turned sideward later.

To assure that the extensible/contractible board 5 can be used also in a case where it is installed on other elbow rest 101 opposite to the first-mentioned elbow rest 101 shown in FIG. 2, the stationary guide plate 1 is formed with the same engagement projections 12 on the opposite side surface as those as described above. In this case, the flange portion 21 of the thrust shaft 2 is brought in engagement with the engagement projections 12 on the opposite side, whereby the stationary guide plate 1 can likewise immovably be held on the thrust shaft 2. Additionally, to assure that the stationary guide plate 1 is held in the completely immovable initial state when it is received in a stepped hole 83 in the base member 8.1, the stationary guide plate 1 is formed with a cutout 13 on the right side as seen in FIG. 7. It should be noted that the cutout 13 is formed by machining a part of the stationary guide plate 1 at a right angle, as shown in FIG. 7.

Figure 1:
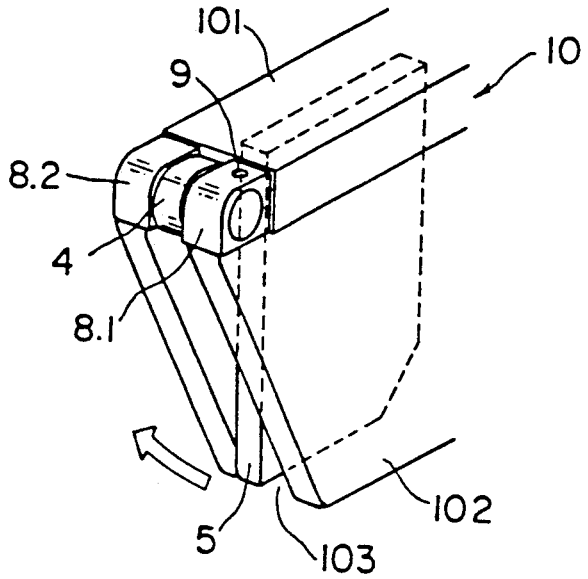
FIG. 1 is a perspective view of an apparatus for displacing an extensible/contractible board for a chair in case of an occurrence of emergency in accordance with an embodiment of the present invention, particularly illustrating an inoperative state wherein the board is received in a hollow space between an opposing pair of sleeve plates below one elbow rest of a chair.
Figure 3:
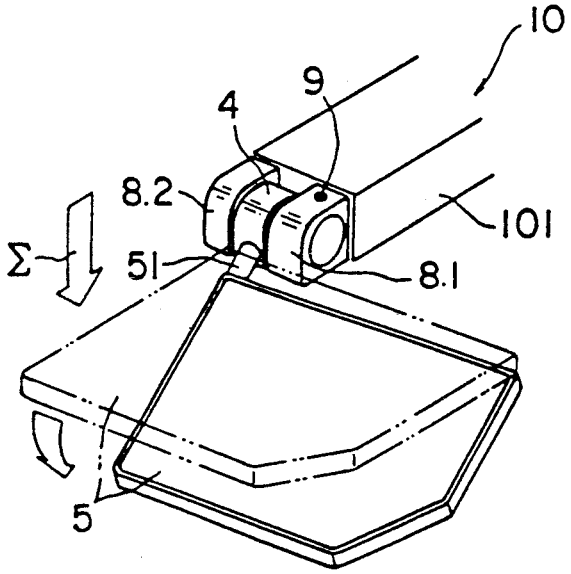
FIG. 3 is a perspective view of the apparatus illustrating an intermediate state wherein an excessive magnitude of outer force is imparted to the board to turn it downwardly away from a horizontal attitude.

As is apparent from FIG. 7, the stationary guide plate 1 is arranged such that it is coaxially received in the base member 8.1 having a heavy thickness and a set screw 9 serving to correctly adjust a state of verticality of the stationary guide plate 1 is then threadably fitted through a threaded hole 84 to come in contact with the upper surface of the cutout 13 until the immovable initial state is established. As shown in FIGS. 1 to 3, the base member 8.1 is fastened to the vertical front surface at the foremost end of the elbow rest 101 of the chair 10 (i.e., in the illustrated case, the vertical front surface at the foremost end of the right-hand elbow rest 101) using set screws or the like means.

After the stationary guide plate 1 is firmly mounted on the thrust shaft 2, the turn guide plate 3 is likewise mounted on the thrust shaft 2 at a position adjacent to the stationary guide plate 1 having the engagement projections 12 formed thereon. The turn guide plate 3 is formed with a shaft hole 31 at the central part thereof through which the thrust shaft 2 is inserted. In addition, the turn guide plate 3 is formed with two semicylindrical engagement recesses 32 on the outside vertical surface thereof adapted to come in engagement with the engagement projections 12 of the stationary guide plate 1. One of the engagement recesses 32 is located above the shaft hole 31 and the other one is located below the shaft hole 31. Further, the turn guide plate 3 is formed with an engagement aperture 33 on the right side to receive the engagement piece 6 to be described in detail later.

To assure that the apparatus can be used for other elbow rest 101 located opposite to the elbow rest 101 shown in FIG. 2, the turn guide plate 3 is additionally formed with other engagement aperture 33 on the left side, as shown in FIG. 7. Additionally, to assure that the engagement piece 6 can be turned together with the board 5 when the board 5 is forwardly taken out of a hollow space 103 defined between an opposing pair of sleeve plates 102 below the elbow rest 101 or it is received therein, the turn guide plate 3 is formed with an arcuate guide groove 34 having a predetermined depth on the opposite vertical surface to the vertical surface on which the engagement recesses 32 are formed.

The turn guide plate 3 as constructed in the above-described manner is turnably mounted on the thrust shaft 2 adjacent to the stationary guide plate 1.

The board support 4 is formed with a shaft hole 41 so that it is turnably mounted on the thrust shaft 2 which is inserted through the shaft hole 41. Further, the board support 4 is additionally formed with a slide hole 42 at a position behind the shaft hole 41 relative to the board 5. The slide hole 42 is located in correct alignment with the one engagement aperture 33 on the turn guide plate 3 and extends in parallel with the shaft hole 41.

The engagement piece 6 having an engagement recess 61 formed thereon is axially slidably inserted through the slide hole 42. A depth of the engagement recess 61 is so determined that the eccentric projection 52 on the board shaft 51 is reliably brought in engagement with the engagement recess 61 on the engagement piece 6. As the board 5 is turned to assume a horizontal attitude while the eccentric projection 52 on the board shaft 51 is held in engagement with the engagement recess 61 of the engagement piece 6, the eccentric projection 52 is turned in the same direction along with the engagement recess 61 on the engagement piece 6, whereby the foremost end of the engagement piece 6 is caused to slidably enter the one engagement aperture 33. Thus, the board support 4 can immovably be held when the board 5 has assumed the horizontal attitude.

The other base member 8.2 is formed with a shaft hole 86 and a spring receiving hole 85 in a coaxial relationship at the central part thereof so that the male-threaded portion 22 of the thrust shaft 2 extends through the shaft hole 86 and the opposing pair of Belleville springs 7 serving as engagement assuring means are received in the spring receiving hole 85. A nut is threadably fitted onto the male-threaded portion 22 of the thrust shaft 2 with a washer interposed between the nut and the one Belleville spring 7. With such arrangement, a predetermined intensity of resilient force is imparted to the turn guide plate 3 via the board support 4 by tightening the nut on the male-threaded portion 22 of the thrust shaft 2.

As shown in FIGS. 1 to 3, the apparatus of the present invention as constructed in the above-described manner is attached to the chair 10 by fastening the both base members 8.1 and 8.2 to the front surface at the foremost end of the one elbow rest 101. When the apparatus is not put in use, the board 5 is turned down to assume a vertical attitude while the board 5 is received in a hollow space 103 defined between an opposing pair of sleeve plates 102 below the elbow rest 101 of the chair 10.

When the board 5 is practically used, it is turned up by an angle of 90 degrees about the thrust shaft 2 away from the vertical attitude until the board shaft 51 extends forwardly to assume its horizontal attitude. Thereafter, as shown in FIG. 2, the board 5 is turned sideward about the board shaft 51 to assume its horizontal attitude in front of an user. At the same time, the eccentric projection 52 on the board shaft 51 which has been engaged with the engagement recess 61 of the engagement piece 6 is likewise turned in the same direction.

Figure 4:
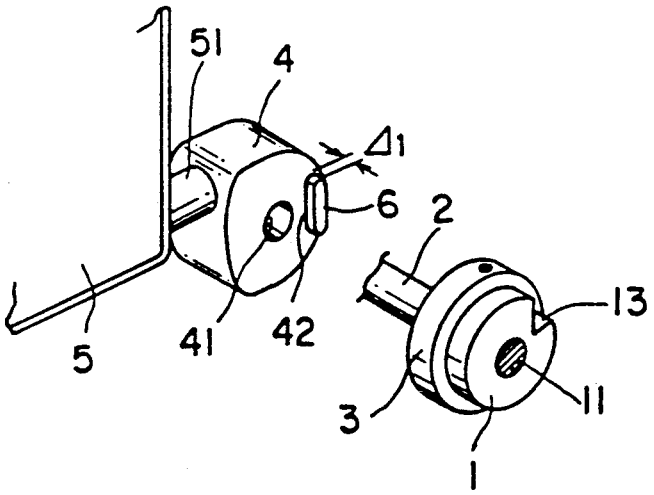
FIG. 4 is a fragmentary perspective view of the apparatus in a disassembled state, particularly illustrating a quantity of outward projection of an engagement piece when the apparatus is held in the inoperative state shown in FIG. 1.
Figure 5:
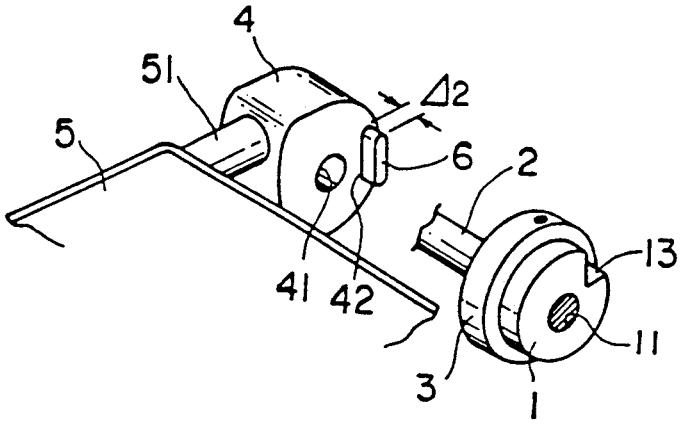
FIG. 5 is a fragmentary perspective view of the apparatus in a disassembled state, particularly illustrating a quantity of outward projection of the engagement piece when the apparatus is held in the intermediate state shown in FIG. 2.
Figure 6:
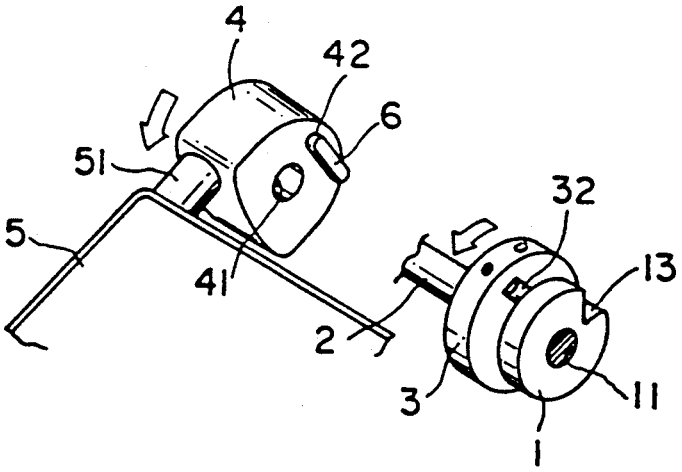
FIG. 6 is a fragmentary perspective view of the apparatus in a disassembled state, particularly illustrating the direction of turning movement of the engagement piece along with a turn guide plate when the apparatus is held in the intermediate state shown in FIG. 3.

As shown in FIG. 4, the foremost end of the engagement piece 6 has been projected by the eccentric projection 52 of the board shaft 51 away from the side surface of the board support 4 by a small quantity of projection $DELTA_1$, before the board 5 is turned sideward to assume the horizontal attitude. Once the board 5 has been turned sideward in that way, the foremost end of the engagement piece 6 is projected outwardly further by an increased quantity of projection $DELTA_2$, as shown in FIG. 5. With such increased projection of the engagement piece 6, the foremost end of the engagement piece 6 is slidably inserted into the one engagement aperture 33 on the turn guide plate 3. At this time, since the board 5 is continuously held in an immovable state while the engagement pieces 12 on the stationary guide plate 1 are firmly engaged with the engagement recesses 32 on the turn guide plate 3 under the effect of resilient force of the Belleville springs 7, the board 5 can stably be used while maintaining the horizontal attitude.

In case of an occurrence of emergency, e.g., earthquake, fire or the like during practical use of the board 5, an excessive magnitude of downward force SIGMA (i.e., an outer force effective in the downward direction in excess of the resilient force given by the Belleville springs 7 which have brought the engagement pieces 12 on the stationary guide plate 1 in engagement with the engagement recesses 32 on the turn guide plate 3) is exerted on the board 5 by the user's hand, as shown in FIG. 3. This allows the board support 4 and the engagement piece 6 which have supported the board 5 to be turned downwardly about the thrust shaft 2, whereby the board 5 is turned downwardly. At this moment, the engagement recesses 32 on the turn guide plate 3 which have been engaged with the engagement projections 12 on the stationary guide plate 1 under the effect of resilient force of the Belleville springs 7 are disengaged from the engagement projections 12 on the stationary guide plate 1 with the result that they are turned in the same direction by a same angular distance. Consequently, the board 5 is displaced from the horizontal attitude to a vertical attitude, resulting in a sufficiently wide passage being provided for the user. Now, he is ready to quickly escape from his chair 10.

If an excessive magnitude of external force SIGMA in excess of the resilient force given by the Belleville springs 7 is unexpectedly loaded on the board 5 during practical use, the board 5 is turned downwardly in the same manner as described above. This prevents essential components associated with the apparatus, i.e., the stationary guide plate 1, the turn guide plate 3, the board support 4, the engagement piece 6 and the both base members 8.1 and 8.2 from being adversely damaged or injured.

As will be readily apparent from the above description, the apparatus of the present invention offers the following advantageous effect.

When the board 5 is practically used while maintaining the horizontal attitude, the engagement projections 12 on the stationary guide plate 1 are brought in engagement with the engagement recesses 32 on the turn guide plate 3 and the engagement piece 6 carried by the board support 4 is slidably fitted into the engagement aperture 33 on the turn guide plate 3 to maintain the immovable state under the effect of resilient force of the Belleville springs 7. Thus, the board 5 can normally be used in a stable state, unless an excessive magnitude of outer force in excess of the resilient force of the Belleville springs 7 is imparted to the board 5.

In case of an occurrence of emergency, e.g., earthquake, fire or the like, there arises a necessity for allowing an user sitting on his chair 10 to quickly escape therefrom. In this case, he is required to exert his powerful force on the board 5 so as to shift the initial horizontal attitude of the board 5 to the vertical attitude by downward turning movement of the board 5 until a sufficiently wide passage is provided in front of him. Thus, since he can quickly escape from the his chair 10, there is no danger that he is hurt or injured.

If an excessive magnitude of outer force is unexpectedly exerted on the board 5, the board 5 is turned down away from the horizontal attitude. This prevents essential components associated with the apparatus, i.e., the board support 4, the engagement piece 6, the turn guide plate 3 and the stationary guide plate 1 from being damaged or injured. Consequently, the apparatus has an increased safety and an excellent reliability.

In addition, since these essential components constituting the apparatus are simple in structure, respectively, the apparatus can economically be constructed in smaller dimensions at a reduced cost.

While the present invention has been described above with respect to a single embodiment, it should of course be understood that it should not be limited only to this but various changes or modifications may be made in an acceptable manner without departure from the scope of the invention as defined by the appended claims.

For example, in the above-described embodiment, Belleville springs 7 serving as engagement assuring means are used for the apparatus of the present invention. However, it should of course be understood that the present invention should not be limited only to the Belleville springs 7. Alternatively, a solenoid adapted to generate the same intensity of resilient force as that of the Belleville springs 7 may be substituted for the Belleville springs 7 with the same operative results.

Further, in the above-described embodiment, the engagement projections 12 on the stationary guide plate 1 and the engagement recesses 33 on the turn guide plate 3 are designed in a semicylindrical geometrical configuration. However, the present invention should not be limited only to this. Alternatively, permanent magnets or solenoids adapted to generate a magnetic beam effective in the axial direction of the thrust shaft 2 so as to allow the turn guide plate 3 to come in contact with the stationary guide plate 1 may be substituted for a combination of the engagement projections 12 and the engagement recesses 33.

What is claimed is:

1. An apparatus for displacing an extensible/contractible board for a chair having an elbow rest in case of an occurrence of emergency, comprising:

a board support for turnably supporting said board, said board support being formed with a bearing hole for rotatably receiving a board shaft made integral with said board, an arcuate recess for turnably receiving an arcuate projection on said board shaft, said arcuate recess being located above said bearing hole, a shaft hole extending at a right angle relative to the board shaft and being located below said bearing hole, and a slide hole for slidably receiving an engagement piece, said slide hole being located at a position behind the shaft hole relative to the board, an engagement piece slidably received in the slide hole of the base support, said engagement piece having an engagement recess formed thereon so as to allow an eccentric projection on the board shaft to be engaged with said engagement recess, a turn guide plate disposed adjacent to the board support to guide turning movement of the board and the board support, said turn guide plate being formed with a shaft hole at the central part thereof, an engagement aperture located in alignment with the slide hole of the board support so that a foremost end of the engagement piece is inserted therethrough when the engagement piece is projected outwardly of the board support by turning movement of the board via operative engagement of the eccentric projection of the board shaft with the engagement recess of the engagement piece, an opposing pair of engagement recesses, one of said engagement recesses being located above the shaft hole and the other one being located below the shaft hole, and an arcuate guide groove for allowing the foremost end of the engagement piece to slidably move therealong when the board is turned from a horizontal attitude and thereby the engagement piece is retracted from a projected state via said operative engagement of the eccentric projection of the board shaft with the engagement recess of the engagement piece, a stationary guide plate having an opposing pair of first engagement projections adapted to be engaged with the engagement recesses of said turn guide plate and an opposing pair of second engagement projections adapted to receive a flange portion of a thrust shaft, said second engagement projections being located opposite to said first engagement projections, a thrust shaft extending through the shaft hole of said stationary guide plate, the shaft at hole of said turn guide plate, the shaft hole of said board support and a shaft hole of one base member at a right angle relative to the board shaft, said thrust shaft including a flange portion held between the second engagement projections of said stationary guide plate to immovably hold the stationary guide plate, and a male-threaded portion at the fore end part thereof, an opposing pair of base members firmly secured to the front surface of the foremost end of said elbow rest of the chair with the board support rotatably interposed therebetween, one of said base members being located adjacent to the board support to receive the turn guide plate and the stationary guide plate in a hole formed therein and the other one being likewise located adjacent to the board support with a spring receiving hole formed therein, and engagement assuring means for firmly holding said board support, said turn guide plate and said stationary guide plate in an operative engagement relationship under the effect of resilient force derived from said engagement assuring means.

2. The apparatus as claimed in claim 1, wherein said engagement assuring means comprises a plurality of Belleville springs for resiliently biasing the board support and the turn guide plate toward the stationary guide plate, said Belleville springs being received in a spring receiving hole of the one base member.

3. The apparatus as claimed in claim 1, wherein said engagement assuring means comprises a solenoid for biasing the board support and the turn guide plate toward the stationary guide plate.

4. The apparatus as claimed in claim 1, wherein each of the engagement projections on the stationary guide plate is contoured in the form of a semicylindrical projection and each of the engagement recesses on the turn guide plate is contoured in the form of a semicylindrical recess.

5. The apparatus as claimed in claim 1, wherein the turn guide plate is formed with another engagement aperture which is located symmetrical to the first-mentioned engagement aperture so as to assure that the apparatus can be used also for other elbow rest of the chair.

6. The apparatus as claimed in claim 1, wherein the stationary guide plate is formed with a cutout with which the foremost end of a set screw comes in contact so that the stationary guide plate is immovably held on the thrust shaft.

7. The apparatus as claimed in claim 1, wherein a depth of the arcuate guide groove of the turn guide plate is determined to coincide with a quantity of retractive displacement of the engagement piece at the time when the board is turned from the horizontal attitude to a vertical attitude.

8. The apparatus as claimed in claim 1, wherein the arcuate projection on the board shaft serves as turning movement limiting means for limiting the range of turning movement of the board from the horizontal attitude to the vertical attitude.

9. The apparatus as claimed in claim 1, wherein the board is received in a hollow space as defined by an opposing pair of sleeve plates when the board is not in use.

* * * * *